US005211920A

United States Patent [19]

Polizzotti

[11] Patent Number: 5,211,920

[45] Date of Patent: * May 18, 1993

[54] AGGLOMERATING AGENTS FOR CLAY CONTAINING ORES

[75] Inventor: David M. Polizzotti, Yardley, Pa.

[73] Assignee: Betz Laboratories, Inc., Trevose, Pa.

[ * ] Notice: The portion of the term of this patent subsequent to Dec. 31, 2008 has been disclaimed.

[21] Appl. No.: 861,054

[22] Filed: Apr. 1, 1992

Related U.S. Application Data

[63] Continuation-in-part of Ser. No. 522,436, May 11, 1990, Pat. No. 5,112,582, which is a continuation-in-part of Ser. No. 508,517, Apr. 9, 1990, abandoned, which is a continuation of Ser. No. 325,608, Mar. 20, 1989, abandoned.

[51] Int. Cl.[5] ..... C01G 7/00; C22B 11/00

[52] U.S. Cl. ..... 423/29; 423/27; 75/747; 75/772

[58] Field of Search ..... 423/27, 29; 75/744, 75/770, 772, 747

[56] References Cited

U.S. PATENT DOCUMENTS

| | | | |
|---|---|---|---|
| 3,418,237 | 12/1968 | Booth et al. | 210/54 |
| 3,660,073 | 5/1972 | Youngs et al. | 75/3 |
| 3,823,009 | 7/1974 | Lailach | 75/3 |
| 3,860,414 | 1/1975 | Lang et al. | 75/3 |
| 3,893,847 | 7/1975 | Derrick | 75/3 |
| 3,898,076 | 8/1975 | Ranke | 75/3 |
| 4,256,705 | 3/1981 | Heinen et al. | 423/27 |
| 4,256,706 | 3/1981 | Heinen et al. | 423/29 |
| 4,362,559 | 12/1982 | Perez et al. | 75/53 |
| 4,802,914 | 2/1989 | Rosen et al. | 75/3 |
| 4,875,935 | 10/1989 | Gross et al. | 75/117 |
| 4,898,611 | 2/1990 | Gross | 75/3 |
| 5,077,021 | 12/1991 | Polizzotti | 423/29 |
| 5,077,022 | 12/1991 | Polizzotti | 423/29 |
| 5,100,631 | 3/1992 | Gross | 423/29 |
| 5,112,582 | 5/1992 | Polizzotti | 423/29 |

*Primary Examiner*—Gary P. Straub
*Assistant Examiner*—Steven Bos
*Attorney, Agent, or Firm*—Alexander D. Ricci; Steven D. Boyd

[57] ABSTRACT

Agglomerating agent and method for use in heap leaching of mineral bearing ores. A moderate to high molecular weight anionic polymer preferably in combination with lime provides a highly effective agglomerating agent. The anionic polymer is preferably a copolymer of acrylamide and acrylic acid. The polymer preferably has a molecular weight of from about 1 to 8 million or higher.

18 Claims, 14 Drawing Sheets

THE EFFECT OF ACRYLAMIDE/ACRYLIC ACID COPOLYMERS ON THE PERCOLATION RATE OF AGGLOMERATED CLAYEY GOLD ORE "A"

AM/AA = ACRYLAMIDE/ACRYLIC ACID MOLE PERCENTS
M.W. = MOLECULAR WEIGHT
H(>8 MILLION). M(1-8 MILLION). L(< 1 MILLION)

THE EFFECT OF ANIONIC POLYMERS ON THE PERCOLATION RATE OF AGGLOMERATED CLAYEY GOLD ORE "B"

EFFECT OF ANIONIC POLYMERS ON THE PERCOLATION RATE OF CEMENT STABILIZED ORE "B"

DRAIN RATE TESTS FOR ORE SAMPLE 'D'

DRAIN RATE TESTS FOR ORE SAMPLE 'D'

DOSE RESPONSE OF 70/30 AM/AA LOW MOLECULAR WEIGHT
SOAK TIME 2 MINUTES

DOSE RESPONSE OF 70/30 AM/AA LOW MOLECULAR WEIGHT
SOAK TIME 30 MINUTES

PERCOLATION RATE ORE SAMPLE D

PERCOLATION RATE ORE SAMPLE D

PERCOLATION RATE ORE SAMPLE D

PERCOLATION RATE ORE SAMPLE D

PERCOLATION RATE ORE SAMPLE D

PERCOLATION RATE ORE SAMPLE D

Break Through Time For Ore Sample D

AGGLOMERATING AGENTS FOR CLAY CONTAINING ORES

This application is a continuation-in-part of application Ser. No. 07/522,436 filed May 11, 1990 now U.S. Pat. No. 5,112,582, which is a continuation-in-part of application Ser. No. 07/508,517 filed Apr. 9, 1990, now abandoned, which is a continuation of application Ser. No. 07/325,608 filed Mar. 20, 1989, now abandoned.

FIELD OF THE INVENTION

The present invention relates to agglomerating agents applied to clay containing ores to be subjected to chemical leaching. The agents of the present invention aid in agglomeration of ores containing an excess of clays and/or fines to allow effective heap leaching for mineral recovery.

BACKGROUND OF THE INVENTION

In recent years, the use of chemical leaching to recover minerals such as precious metals from low grade ores has grown. For example, caustic cyanide leaching is used to recover gold from low grade ores having about 0.02 ounces of gold per ton. Such leaching operations are typically carried out in large heaps. The mineral bearing ore from an open pit mine is crushed to produce an aggregate that is coarse enough to be permeable in a heap but fine enough to expose the precious metal values such as gold in the ore to the leaching solution. After crushing, the ore is formed into heaps on impervious leach pads. A leaching solution is evenly distributed over the top of the heaps by sprinklers, wobblers, or other similar equipment at a rate of from about 0.003 to 0.005 gallons per minute per square foot. As the barren leaching solution percolates through the heap, it dissolves the gold contained in the ore. The liquor collected by the impervious leach pad at the bottom of the heap is recovered and this "pregnant solution" is subjected to a gold recovery operation. The leachate from the gold recovery operation is held in a barren pond for reuse.

Economical operation of such heap leaching operations requires that the heaps of crushed ore have good permeability after being crushed and stacked so as to provide good contact between the ore and the leachate. Ores containing excessive quantities of clay and/or fines (i.e., 30% by weight of −100 mesh fines) have been found undesirable due to their tendency to slow the percolation flow of the leach solution. Slowing of the percolating flow of leach solution can occur when clay and/or fines concentrate in the center of the heap while the large rock fragments tend to settle on the lower slopes and base of the heap. This segregation is aggravated when the heap is leveled off for the installation of the sprinkler system that delivers the leach solution. This segregation results in localized areas or zones within the heap with marked differences in permeability. The result is channeling where leach solution follows the course of least resistance, percolating downward through the coarse ore regions and bypassing or barely wetting areas that contain large amounts of clay and/or fines. Such channelling produces dormant or unleached areas within the heap. The formation of a "slime mud" by such fines can be so severe as to seal the heap causing the leach solution to run off the sides rather than to penetrate. This can require mechanical reforming of the heap. The cost in reforming the heaps which can cover 160 acres and be 200 feet high negates the economics of scale that make such mining commercially viable.

In the mid-1970's, the United States Bureau of Mines determined that ore bodies containing high percentages of clay and/or fines could be heap leached if the fines in the ore were agglomerated. The Bureau of Mines developed an agglomeration process in which crushed ore is mixed with Portland Cement at the rate of from 10 to 20 pounds per ton, wetted with 16 to 18% moisture (as water or caustic cyanide), agglomerated by a disk pelletizer and cured for a minimum of 8 hours before being subjected to stacking in heaps for the leaching operation. When processed in this manner, the agglomerated ore was found to have sufficient green strength to withstand the effects of degradation caused by the heap building and leaching operations.

In commercial practice, the method developed by the United States Bureau of Mines has not met with widespread acceptance because of the cost and time required. However, the use of cement, as well as lime, as agglomerating agents is known. Agglomerating practices tend to be site specific and non-uniform. Typically, the action of the conveyor which moves the ore from the crusher to the ore heaps or the tumbling of ore down the conical pile is relied on to provide agglomeration for a moistened cement-ore mixture. Lime has been found to be less effective than cement in controlling clay fines. It is believed this is because the lime must first attack the clay lattice structure in order to provide binding.

Cement has been found to be most effective in high siliceous ores (crushed rock) and noticeably less effective in ores having a high clay content. The large volumes of cement required also present problems. The transportation to and storage of large volumes of dusty cement at the often remote mine locations is difficult. With the growth of such mining methods, the need for cost effective, efficient agglomerating materials has grown.

It is an object of the present invention to provide an agglomerating agent for use in the heap leaching of mineral bearing ores which improves the permeability of the heap.

It is a further object of the present invention to provide an agglomerating agent for use in heap leaching of mineral bearing ores which eliminates or reduces ponding and channeling of the leach solution.

It is an additional object of the present invention to provide an agglomerating agent for use in heap leaching of mineral bearing ores which improves ore extraction from material having a size of less than about 50 microns.

It is an additional object of the present invention to provide an agglomerating agent which allows finer crushing of the mineral bearing ore without a deleterious influence on percolation rate of leach solution through ore heaps.

SUMMARY OF THE INVENTION

The present invention is directed toward new and improved agglomerating agents for use in heap leaching of ores. More specifically, the present invention is directed toward a new agglomerating agent comprising a moderate to high molecular weight synthetic polymer preferably in combination with lime and preferably in the absence of cement. Preferably, the agglomerating agent of the present invention is an anionic copolymer of an acrylamide and an acrylic acid with lime. It was discovered that such polymers in combination with reduced quantities of lime provide highly effective agglomerating agents. The effectiveness of the agglomerating agents of the present invention was determined in standardized water stability testing.

Water stability measurements were made which reflect an agglomerating agent's ability to interact with the arrangement of clay/soil particles and pore geometry within the aggregate as these factors determine an agglomerate's mechanical strength, permeability and erodability characteristics. The standardized testing employed is based upon the fact that poorly stabilized agglomerates swell, fracture and disintegrate upon contact with water to release a large number of fines. The "slime mud" that forms as a consequence of agglomerate degradation retards the percolation rate (i.e., drain rate) of the column of agglomerate. The standardized testing was engineered so as to control agglomerate formation, moisture content, fines/solid ratio, surface area, particulate size, etc., in order to allow comparison of the results of the different runs.

The preferred copolymer of the present invention is a 70/30 mole percent acrylamide/acrylic acid copolymer preferably in combination with lime at a treatment rate of 0.25 pounds per ton polymer and 5.0 pounds per ton lime. The preferred treatment will vary with the ore sample as shown by the examples below. The selection of the properties of an agglomerating agent (i.e., the molecular weight, mole ratio of copolymer, ratio of polymer to lime and application rate) is a function of the actual ore to be treated. In practice, bench scale testing will allow selection of the most effective polymer/lime combination for a specific ore. Preferably, sufficient lime is added to provide a pH of from 9.5 to 11. Typically from about 1–10 pounds of lime is added per ton of mineral bearing ore.

DETAILED DESCRIPTION OF THE PREFERRED EMBODIMENT

Figure 1:
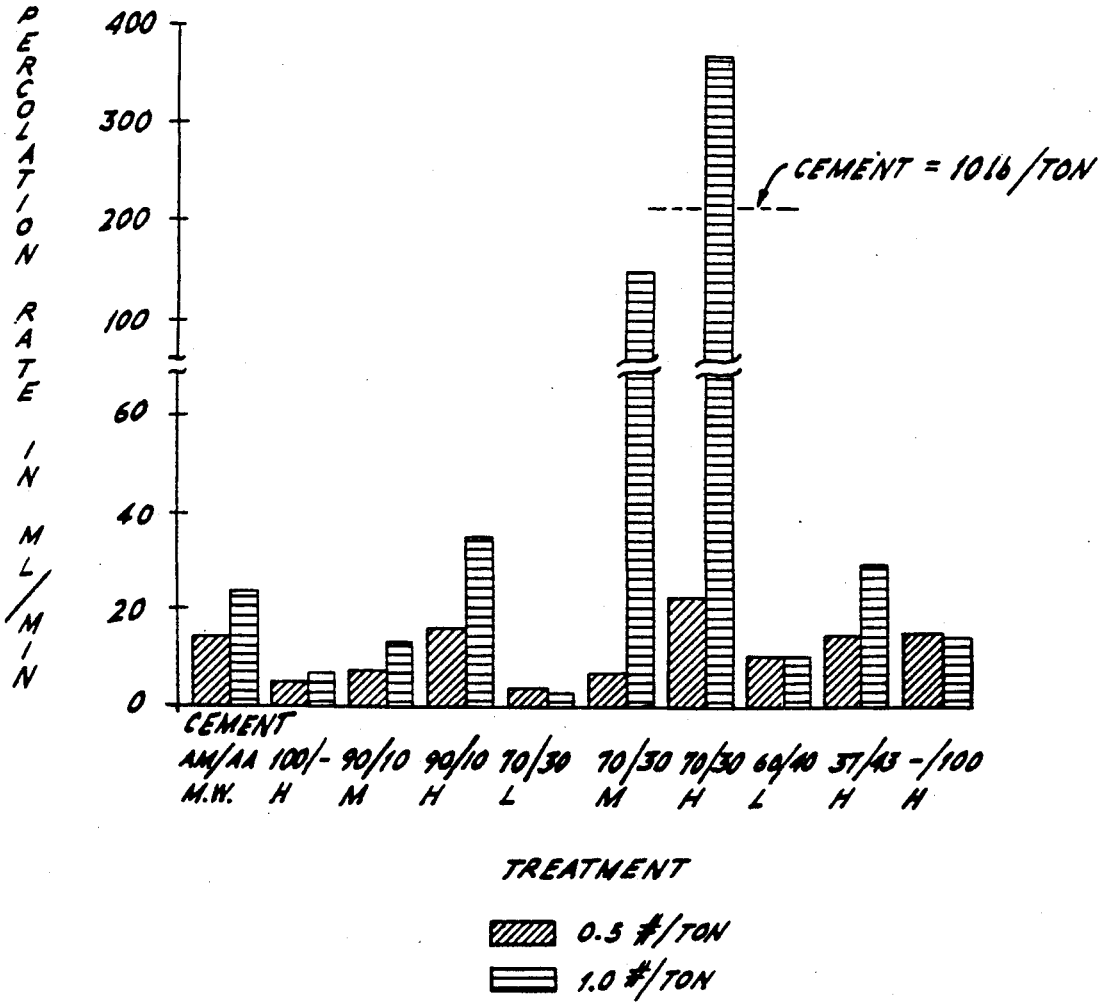
FIGS. 1, 2 and 3 are graphs showing the percolation rate in milliliters per minute for various ores and treatments as described below.

The present invention provides a new agglomerating agent for use in heap leaching of ores. It has been discovered that a moderate or high molecular weight acrylamide/acrylic acid polymer in combination with lime and preferably in the absence of cement provides effective agglomerating action in mining operations. The agglomerating agents of the present invention were found to be more effective than cement as an agglomerating agent and avoid the problem associated with cement.

To allow comparison of the efficiency of the agglomerating agents of the present invention when applied to different ores, standardized testing procedures were developed. These procedures allow the efficiency of the various agglomerating agents to be compared. The first procedure measures the percolation rate of a predetermined volume of a leachate solution through a column of agglomerated ore. The procedure uses water stability to measure the strength of the agglomerated ores. The procedure takes into account the fact that poorly stabilized agglomerates swell, fracture and disintegrate upon contact with water to release a large number of fines. The slime mud which forms as a consequence of agglomerate degradation retards the percolation rate of the leach solution through the agglomerated ore. The test procedure is designated to take into account effects such as variable surface area that are associated with raw crushed ore. Tables 1–3 and FIGS. 1–3.

The second procedure measures the percolation rate as a function of time as well as the breakthrough time and solids content in the leachate for a specially prepared agglomerate. The specially prepared agglomerate comprises an ore sample having a particulate size weight fraction distribution of 11% W/W -2 to 1 inch; 20.8% W/W—1 to 1½ inch; 42.8% W/W —½ to 10 mesh; 25.4% W/W 10 mesh. Each such sample was agglomerated by a "bucket transfer" method which comprised transferring the ore from bucket to bucket 10 times to simulate conveyor belt transfer points. During the bucket transfer operation moisture was added via a spray. The moisture content of the ore was adjusted to approximately 12% by weight. The agglomerating treatment was added to the ore during transfer from bucket to bucket either as a powder or in the moisture spray. After agglomeration, the ore was transferred to a column having three ½ inch drain ports. The ore was supported on a wide mesh (¼Δ square) screen to control plugging of the drain ports. The agglomerated ore was cured for approximately 16 hours. Percolating solution was distributed over the ore from the top of the column. The percolation rate, as a function of time, the breakthrough time and solids content of the leachate was measured for each run. The percolating solution was added to the column via a pump and timing mechanism. The percolation rate was adjusted to deliver 0.005 gallons per minute per square foot at the intermittent rate of 57 cubic centimeters in 15 seconds every 15 minutes.

The percolation rate, in milliliters per minute measured in the first procedure measures the flow of the percolation solution from the agglomerate after soaking and a higher flow rate is desirable as indicating a lack of formation of slime mud plugging the column. The second procedure measures the flow of percolation solution through the agglomerate or column and lower flow rates indicate the percolation solution is flowing through the agglomerate rather than around or over it.

The preferred agglomeration agent of the present invention comprises an anionic copolymer of acrylamide and acrylic acid in combination with lime and preferably in the absence of cement. It is believed that comparable or better performance would be achieved if the copolymer solution were applied as a foam wherein copolymer distribution would be improved. It was discovered that with the preferred agglomerating agent, efficiency was somewhat influenced by the composition of the ore to be treated.

Figure 2:
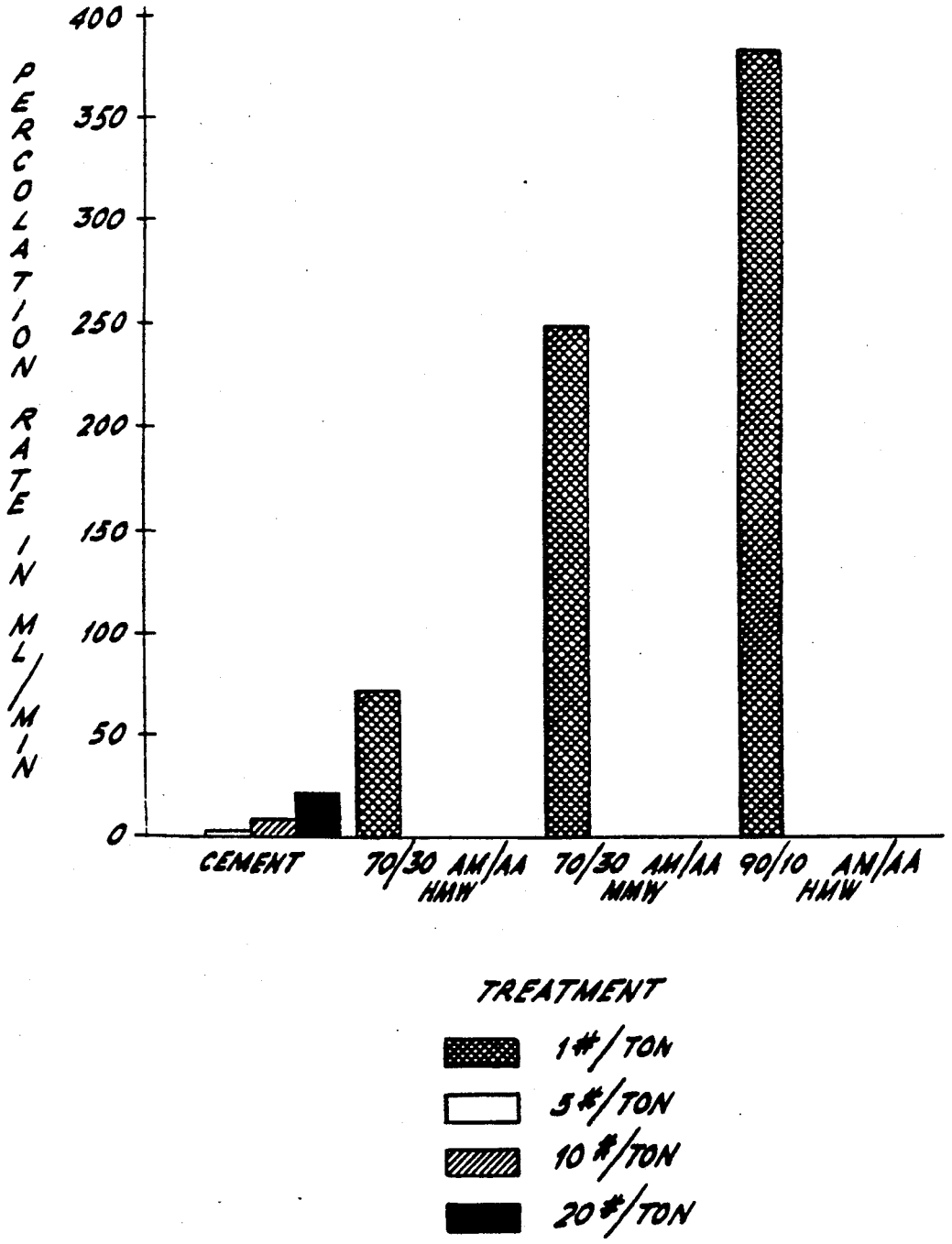
Figure 3:
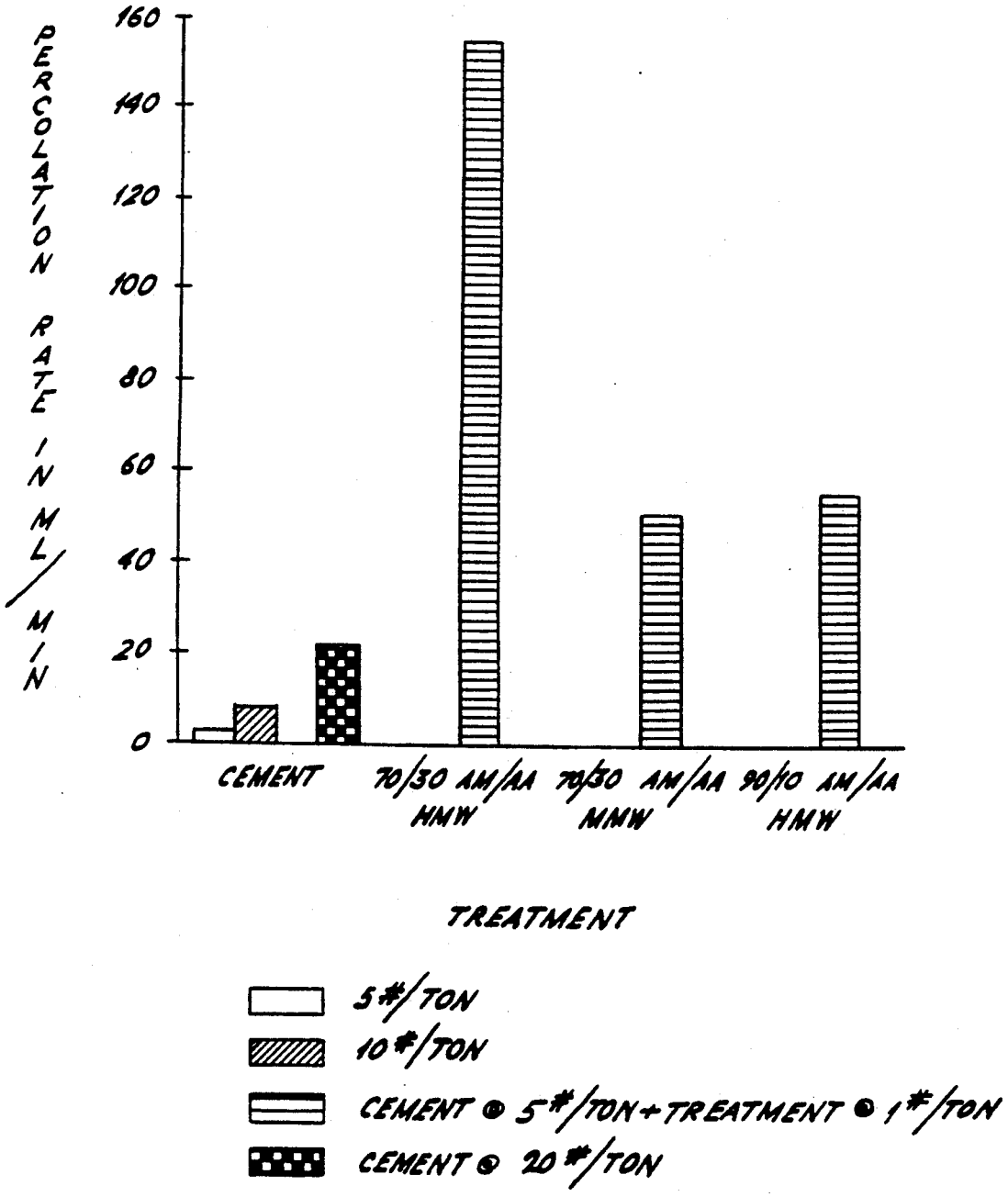

FIGS. 1, 2, and 3 and Tables 1, 2, and 3 summarize data collected with the first procedure.

A comparison of FIGS. 1 and 2 shows that the selection of the most efficient copolymer will be, in part, dependent upon the ore to be treated. FIG. 1 summarizes data relative to the agglomeration effect of prior art cement and acrylamide/acrylic acid copolymers of varying monomer ratio and molecular weights. The data summarized in FIG. 1 relates to a clay containing ore, designated ore A. FIG. 2 summarizes data collected in the testing of prior art cement and acrylamide/acrylic acid copolymers of varying monomer ratio and molecular weight for another clay containing gold ore, designated ore B.

As can be seen from FIG. 1, for the ore A, the most effective polymer agglomerating agent, as evidenced by the high percolation rate, is an anionic, high molecular weight, 70/30 acrylamide/acrylic acid copolymer. As shown in Table 1, these agglomerating agents are effective when used in combination with cement.

TABLE 1

Effect of Anionic Acrylamide/Acrylic Acid Copolymers on the Percolation Rate of Cement Stabilized Ore "A" Agglomerates. In these tests, Ore "A" Agglomerates were stabilized with Cement at 5 Pounds/Ton.

| Treatment | Application Rate (Pounds/Ton) | Percolation Rate (ML/Min) | Molecular Weight |
|---|---|---|---|
| Cement | 5 | 119 | — |
| Cement | 10 | 217 | — |
| Cement | 20 | 500 | — |
| 70/30 AM/AA* | 1.0 | 455 | 12–16 × $10^6$ |
| 70/30 AM/AA* | 1.0 | 455 | 2–4 × $10^6$ |
| 90/30 AM/AA* | 1.0 | 500 | 12–16 × $10^6$ |

*70/30 AM/AM refers to a 70/30 mole ratio copolymer of acrylamide (AM) and acrylic acid (AA). 90/10 AM/AA is a 90/10 mole ratio of acrylamide to acrylic acid.

From FIG. 2, for ore B, it can be seen that the most effective agglomerating agent was an anionic, high molecular weight, 90/10 acrylamide/acrylic acid copolymer. As can be seen from the figures, the efficiency of the agglomerating agent can be maximized by varying the ratio of monomers in the copolymer, the molecular weight of the copolymer and the treatment rate.

The fact that the copolymer used for ore A did not provide optimum percolation rates for ore B underscores the fact that the copolymer mole ratio and molecular weight selected for a given application will, to a large extent, depend on the nature of the ore body.

FIG. 3 summarize the data relative to the effectiveness of the agglomerating agents of the present invention on ore B when used in combination with cement.

The results summarized in Table 2 and 3 further illustrate the effectiveness of the medium and high molecular weight 70/30 and 90/10 mole percent acrylamide/acrylic acid copolymers relative to cement as agglomerating agents.

As shown in Table 2, Portland Cement was of little value in enhancing the percolation rate of ore C, a high clay content ore. In the case of ore C, cement at 20 #/ton appeared to have a negative impact on percolation rate. For ore C, lime was not an effective agglomerating agent.

When ore C was treated with the acrylamide/acrylic acid copolymers significant improvements in the percolation rate values were realized. As shown, the percolation rate of ore C increased from 134 ml/min when treated with cement at 10 #/ton to 417 ml/min when treated with a high molecular weight 70/30 mole percent acrylamide/acrylic acid copolymer at 0.5 #/ton. As shown in Table 3, these polymers may be used in combination with cement.

TABLE 2

Effect of Anionic Acrylamide/Acrylic Acid Copolymers on The Percolation Rate of Ore "C"

| Treatment | Application Rate (Pounds/Ton) | Percolation Rate (ML/Min) | Molecular Weight |
|---|---|---|---|
| Control | — | 24 | — |
| Cement | 5 | 30 | — |
| Cement | 10 | 134 | — |
| Cement | 20 | 34 | — |
| Lime | 5 | 6 | — |
| Lime | 10 | 3 | — |
| Lime | 20 | 3 | — |
| 70/30 AM/AA* | 0.5 | 417 | 12–16 × $10^6$ |
| | 1.0 | 332 | 12–16 × $10^6$ |
| | 2.0 | 401 | 12–16 × $10^6$ |
| 70/30 AM/AA* | 0.5 | 333 | 2–4 × $10^6$ |
| | 1.0 | 361 | 2–4 × $10^6$ |
| | 2.0 | 356 | 2–4 × $10^6$ |
| 90/10 AM/AA* | 0.5 | 385 | 12–16 × $10^6$ |
| | 1.0 | 361 | 12–16 × $10^6$ |
| | 2.0 | 359 | 12–16 × $10^6$ |

*70/30 AM/AA is a 70/30 mole percent acrylamide (AM)/Acrylic Acid (AA) copolymer. 90/10 AM/AA is a 90/10 mole percent acrylamide/acrylic acid copolymer.

TABLE 3

Effect of Anionic Acrylamide/Acrylic Acid Copolymers on the Percolation Rate of Cement Stabilized Ore "C" Agglomerates. In these tests, Ore "C" Agglomerates were stabilized with Cement at 5 Pounds/Ton.

| Treatment | Application Rate (Pounds/Ton) | Percolation Rate (ML/Min) | Molecular Weight |
|---|---|---|---|
| 90/10 AM/AA | 1.0 | Test 1 96 | 12–16 × $10^6$ |
| | | 2 200 | |
| | | 3 119 | |
| | 2.0 | Test 1 333 | |
| | | 2 179 | |
| 70/30 AM/AA | 1.0 | Test 1 278 | 12–16 × $10^6$ |
| | | 2 250 | |
| | | 3 385 | |
| | 2.0 | Test 1 385 | |
| | | 2 333 | |
| 70/30/ AM/AA | 1.0 | Test 1 333 | 2–4 × $10^6$ |
| | | 2 278 | |
| | | 3 333 | |
| | 2.0 | Test 1 294 | |
| | | 2 417 | |

Testing of ore sample "D" included both the first procedure described above (on sample of −10 mesh) as well as the second procedure. The samples were treated with cement, lime and a combination of acrylamide/acrylic acid copolymer and lime. The use of lime in combination with an acrylamide/acrylic acid copolymer allowed for the control of pH (as with prior art cement agglomeration) at significantly lower treatment levels. It was found that 0.88 pounds of lime per ton of treated material provided comparable pH control to cement treatment at 6 pounds per ton for ore sample "D". It is expected however that the nature of the ore will dictate the amount of lime needed for protective alkalinity so that conventional heap leaching may be practical. This level of lime treatment was included in all testing of copolymers on ore sample "D". In the testing of ore sample "D", the agglomerated ore was allowed to cure for 16 hours. After curing, the agglomerates were soaked for two minutes in an aqueous solution containing 300 ppm calcium as calcium carbonate. Lime was employed to provide the alkalinity and calcium content of the soak solution. After the two minute soak, the solution was drained and columns of agglomerate material re-soaked in fresh solution for 30 minutes. Agglomerates dissintegrated and the fines settled to the bottom of the column establishing a "fines bed". At the end of each soak, the time to drain ½ of the volume of solution initially added to the column was recorded as the drain rate (this is the first procedure described above).

Figure 4:
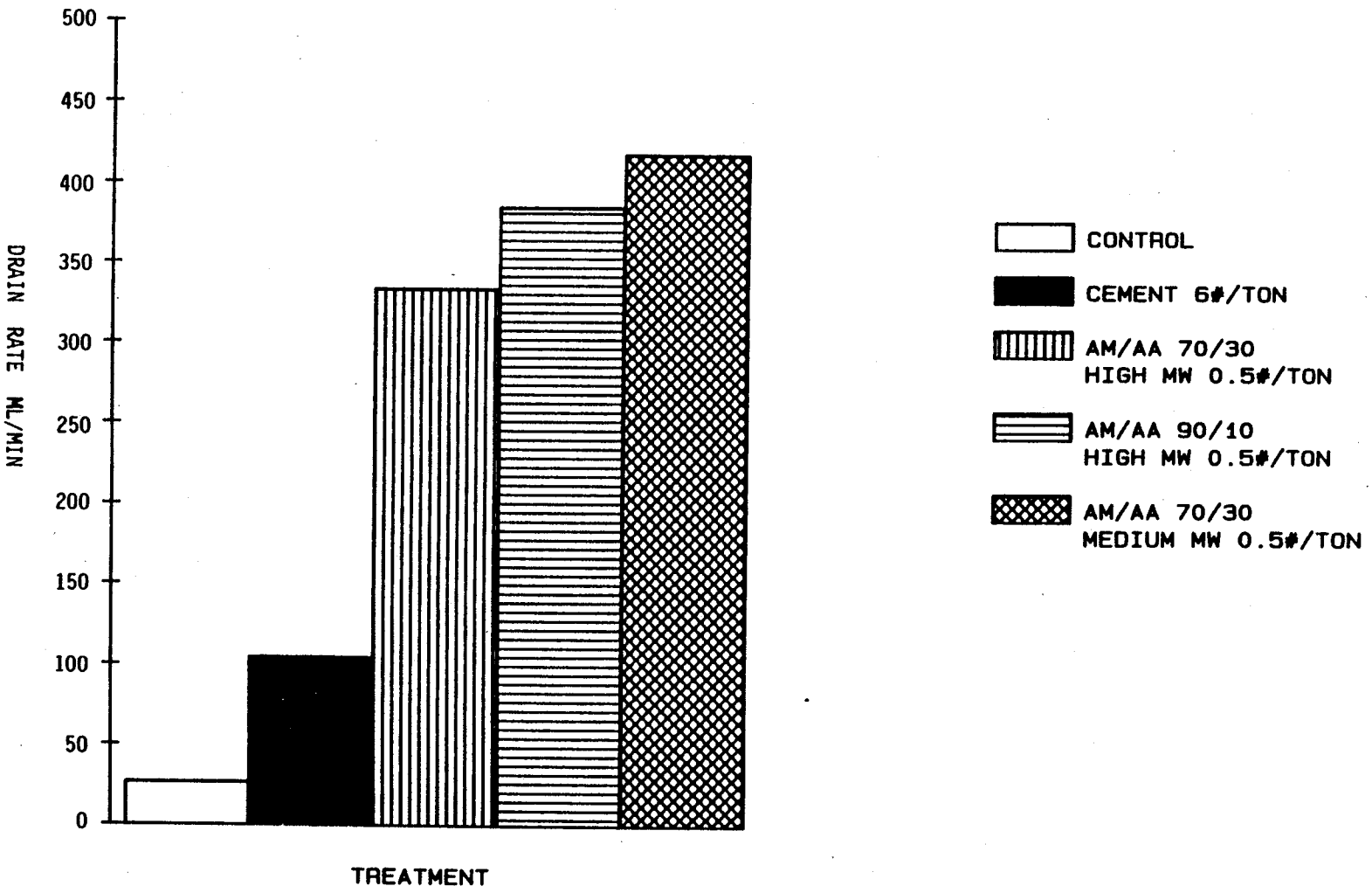
FIGS. 4, 5, 6 and 7 are graphs showing the drain rate in milliliters per minute for various treatments as described below.
Figure 5:
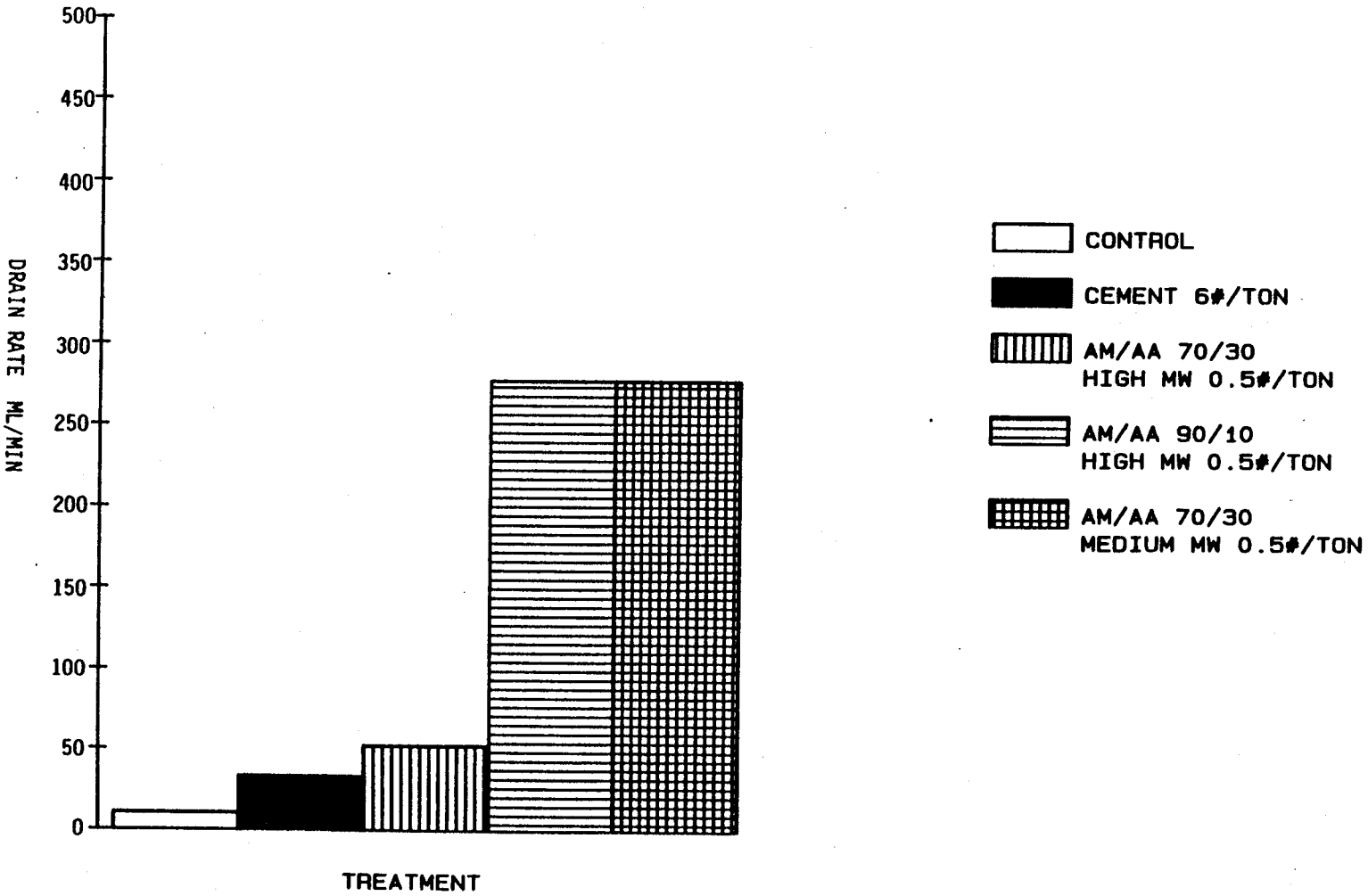

FIGS. 4 and 5 summarize data relative to untreated ore sample "D" and the effectiveness of treatment with 6 pounds per ton of cement as well as treatment with an acrylamide/acrylic acid copolymer plus lime treatment. The treatment levels for the copolymer were 0.5 pounds per ton and 0.88 pounds per ton lime.

As shown in FIG. 4, after a two minute soak cement treated ore was about 3 times more stable than untreated ore sample "D". Agglomerates treated with the combination of the present invention, acrylamide/acrylic acid plus lime, were from 3 to 4 times more stable than cement treated ore.

Figure 6:
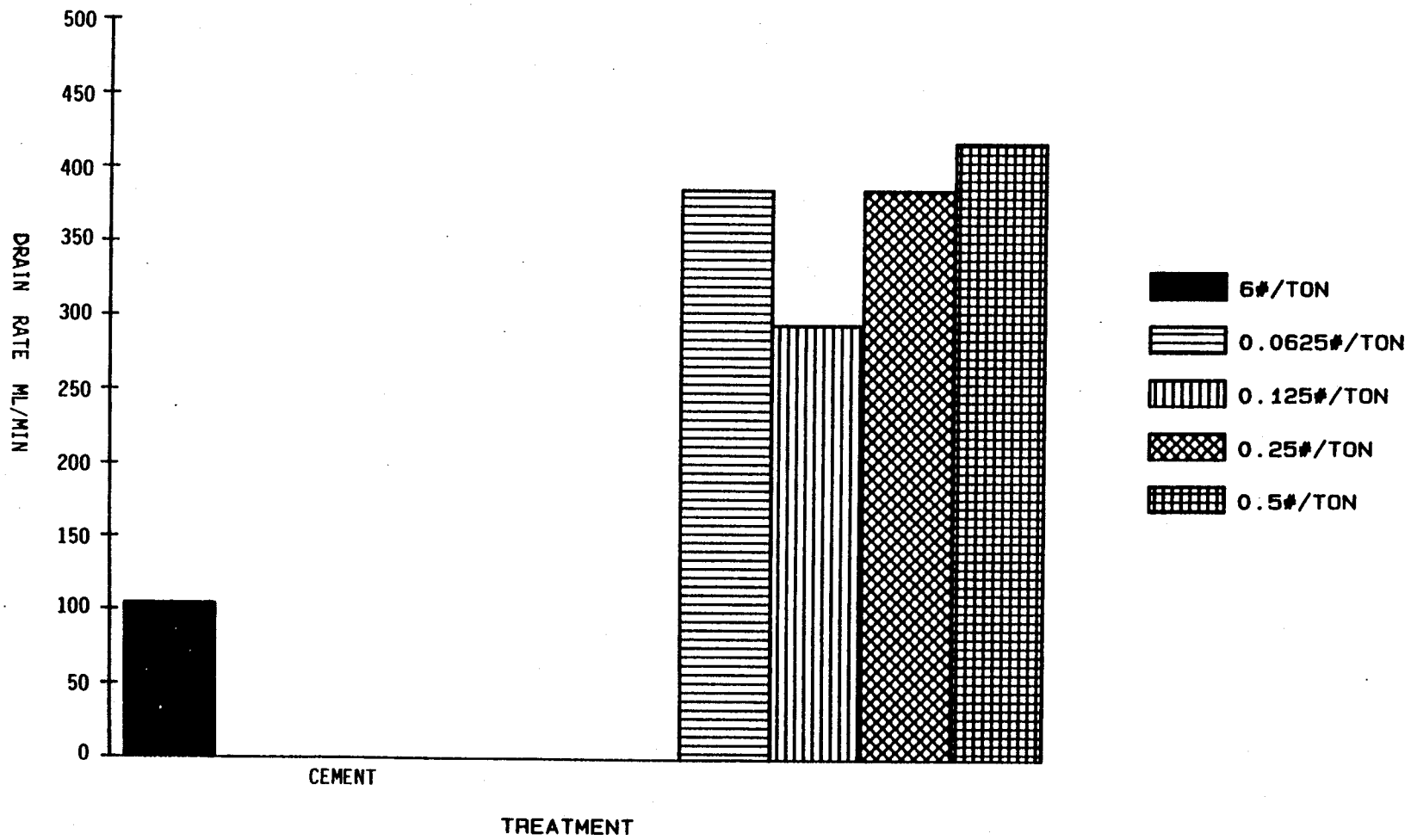
Figure 7:
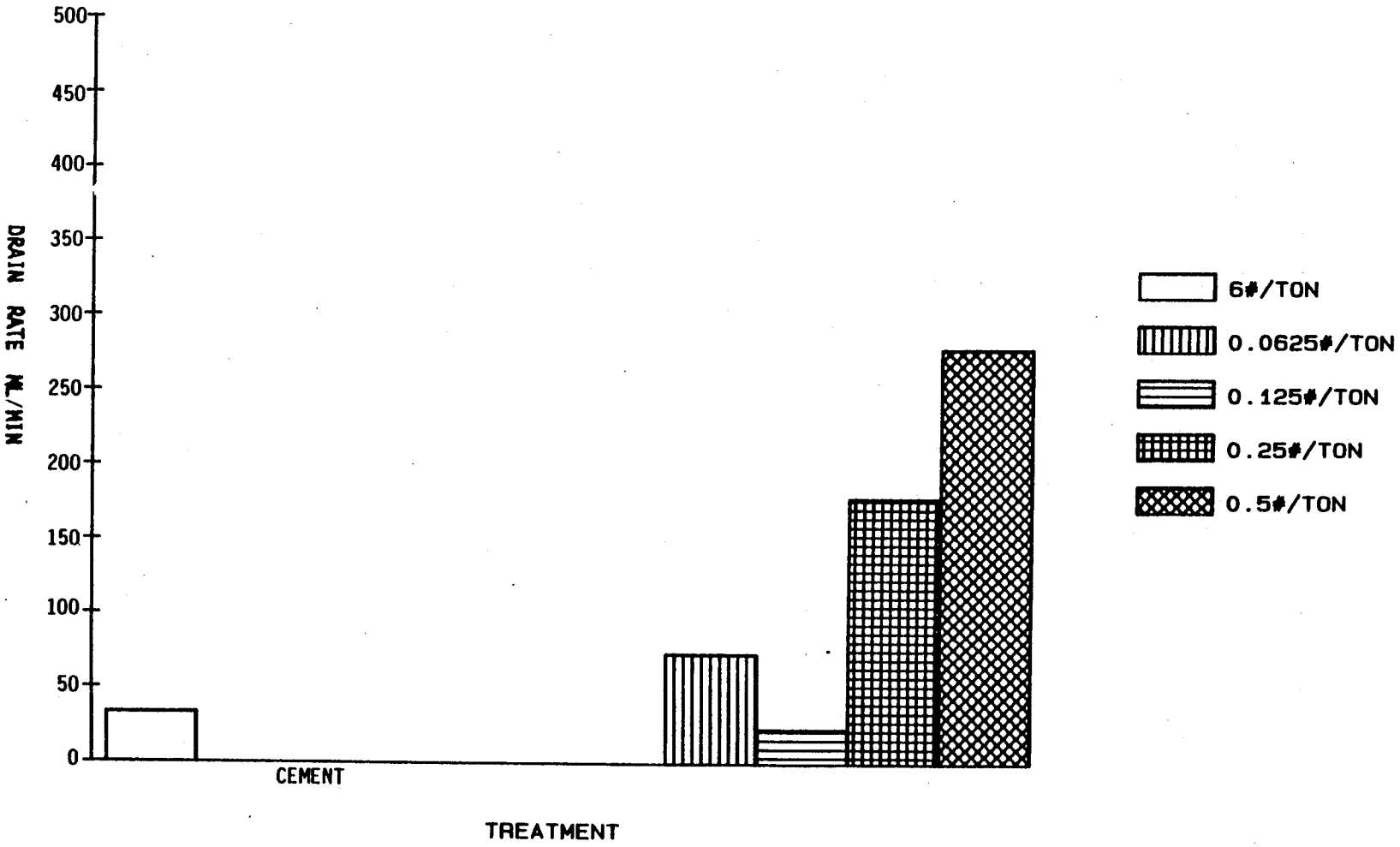
Figure 8:
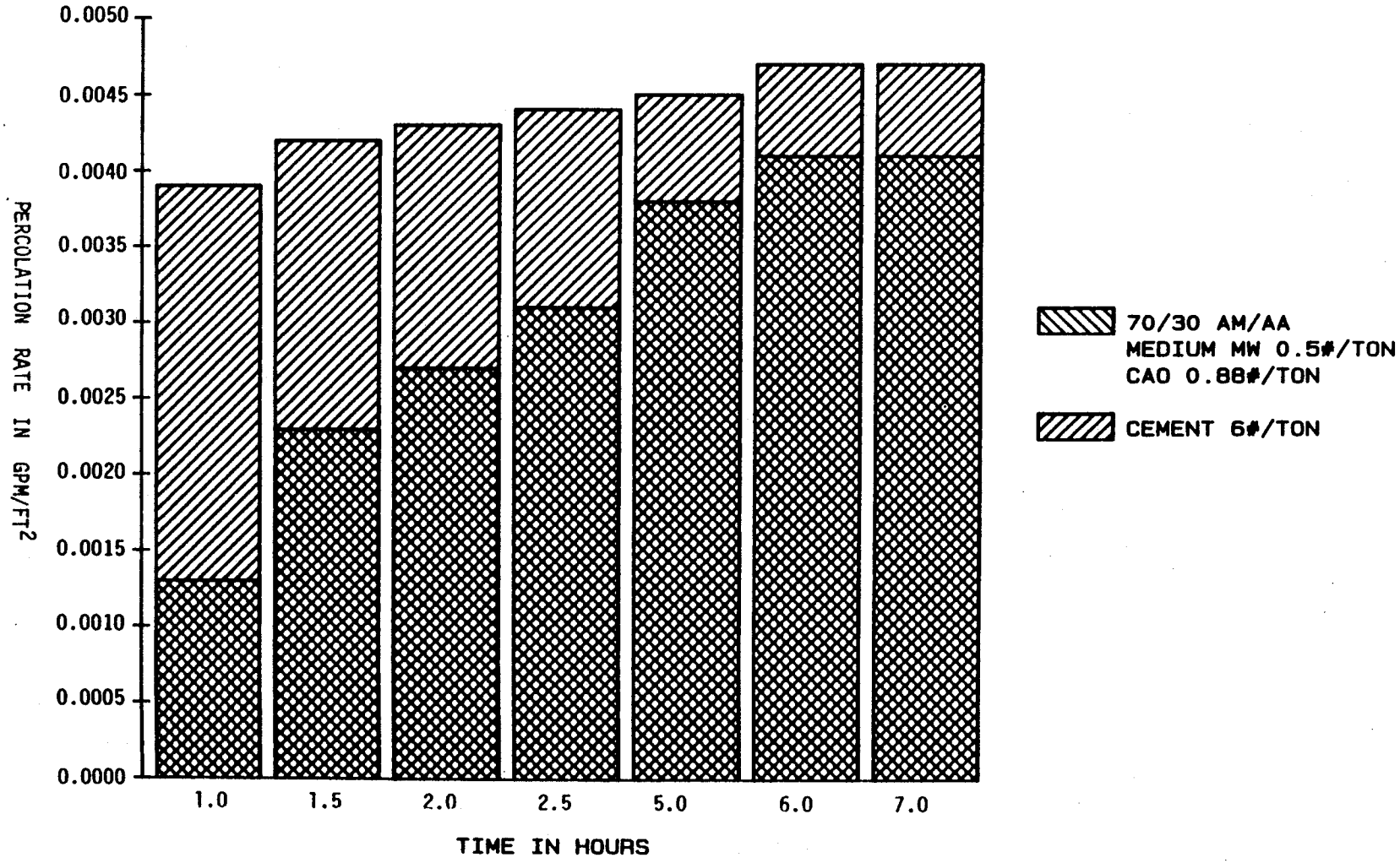
FIGS. 8, 9, 10, 11, 12 and 13 are graphs showing the percolation rate in gallons per minute per square foot for various treatments as described below.
Figure 9:
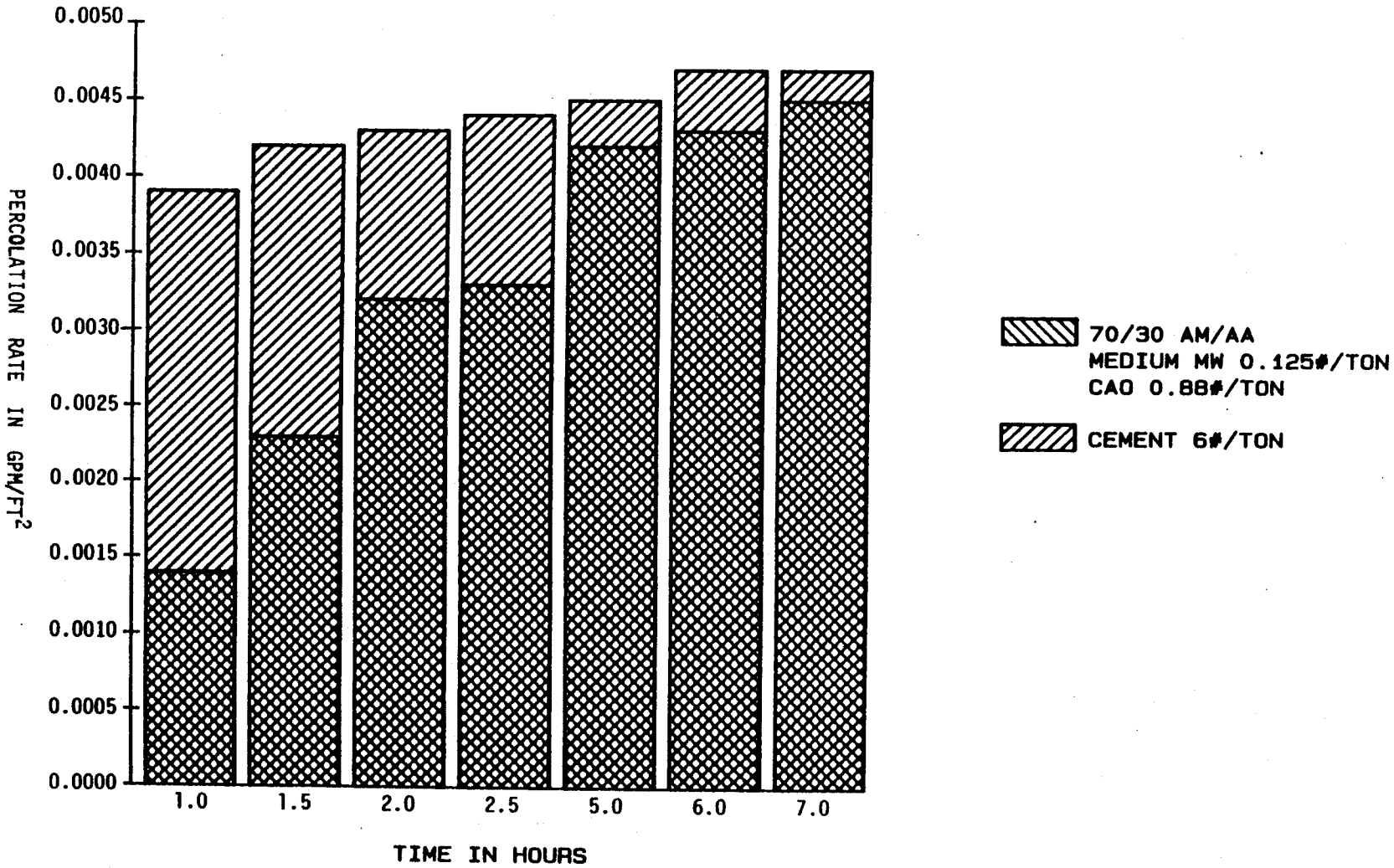
Figure 10:
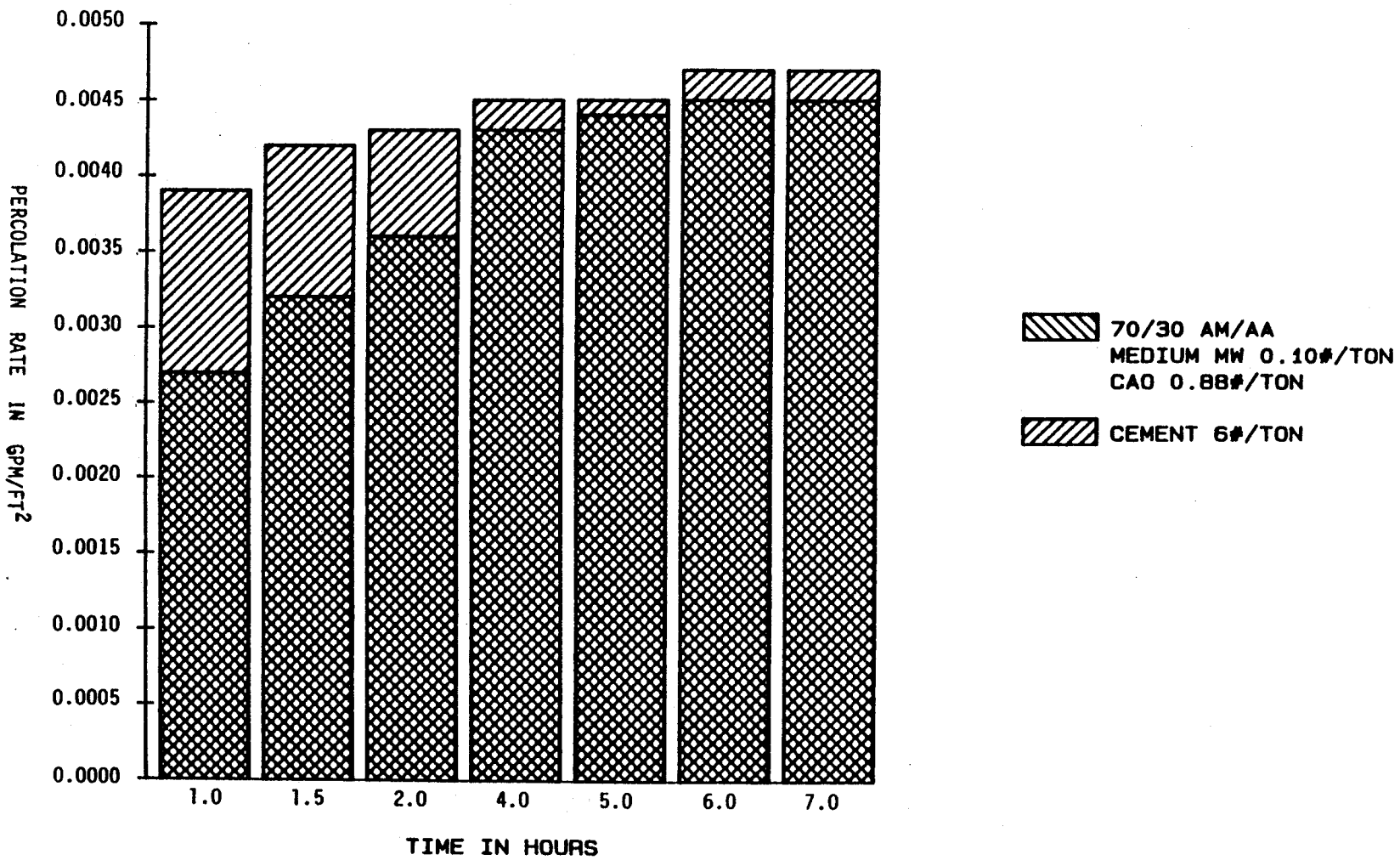
Figure 11:
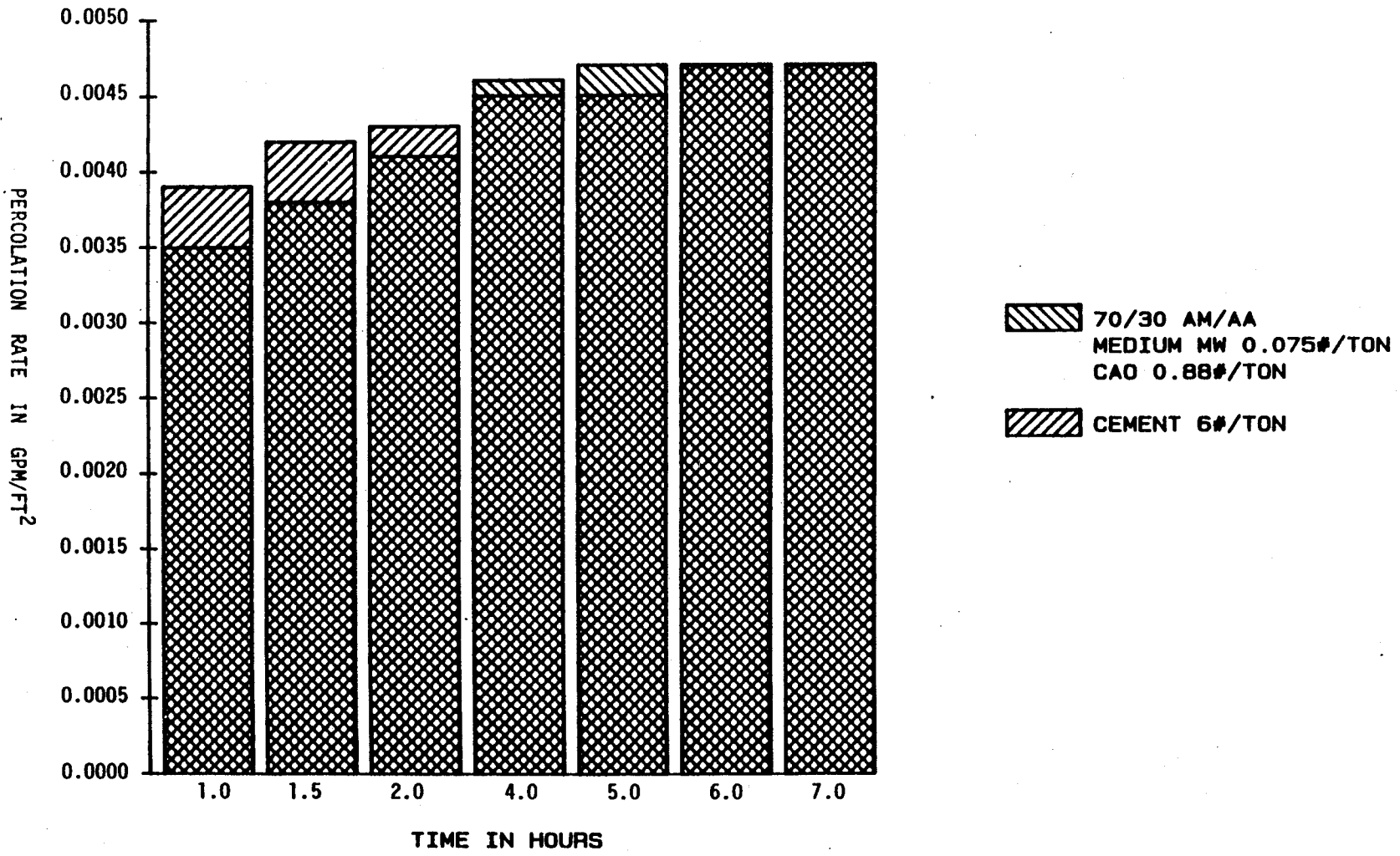
Figure 12:
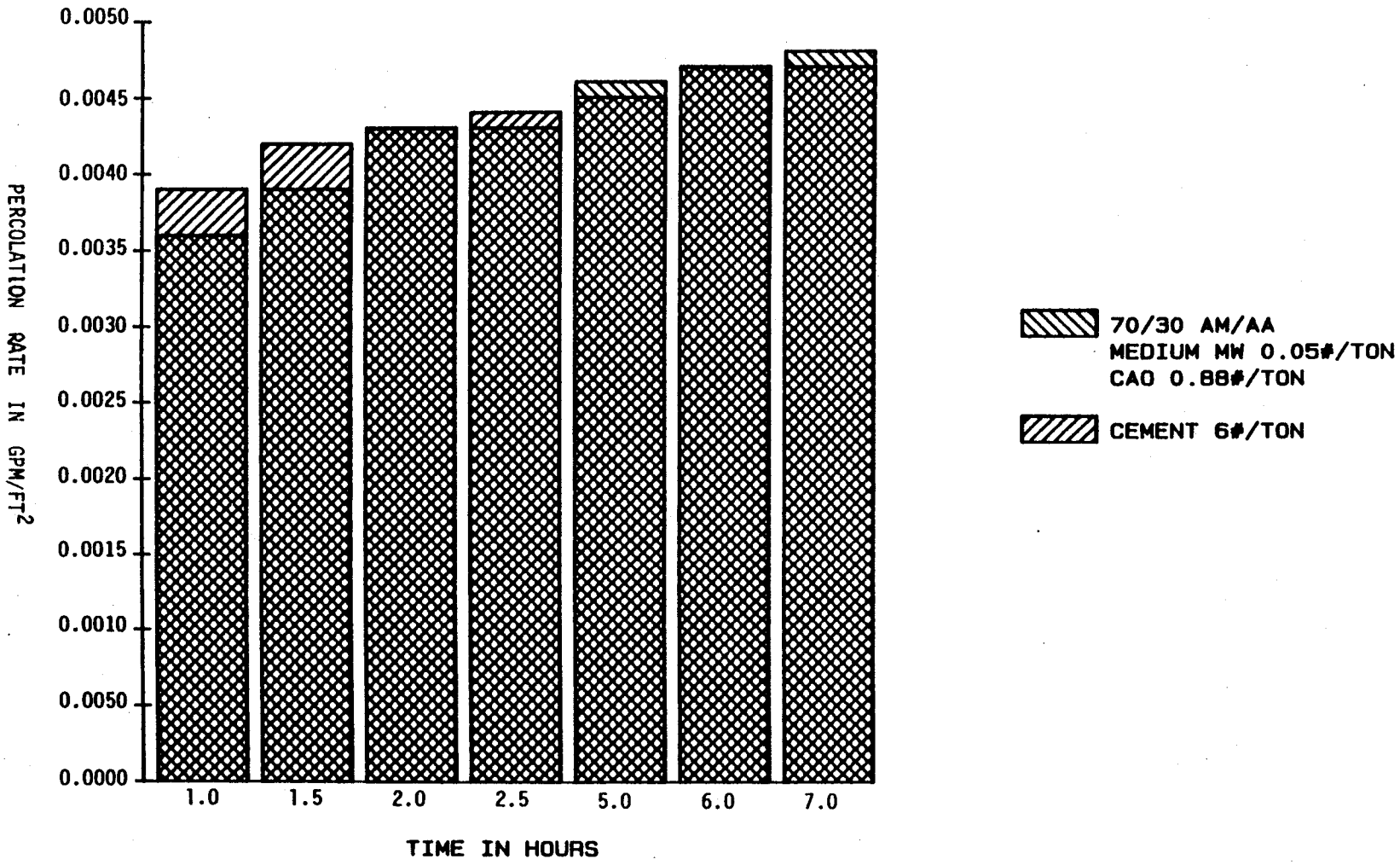

FIG. 5 shows that after a 30 minute soak, cement treated agglomerate showed a marked deterioration in stability as did the copolymer treatment of 70/30 AM/AA high molecular weight copolymer. However, the 90/10 AM/AA high molecular weight and 70/30 AM/AA moderate molecular weight copolymers in combination with lime maintained excellent stability. FIGS. 6 and 7 summarize data of dose-response testing for the 70/30 AM/AA moderate molecular weight agglomerating agent and lime after a 2 minute soak (FIG. 6) and a 30 minute soak (FIG. 7). As shown in FIG. 6 treatment levels as low as 0.0625 pounds per ton of the 70/30 AM/AA moderate molecular weight copolymer in combination with 0.88 pounds per ton lime were considerably more effective than cement as evidenced by the much higher drain rate. In the case of a 30 minute soak, a break in effectiveness is noted at treatment levels below 0.125 pounds per ton copolymer plus 0.88 pounds per ton lime.

As shown in FIGS. 4 through 7 the combination of acrylamide/acrylic acid and lime provides agglomeration significantly better than cement at reduced treatment levels. Lime, which is a relatively poor agglomeration agent by itself (see Table 2) can provide effective pH control comparable to cement at reduced treatment levels and does not adversely effect the agglomeration action of an acrylamide/acrylic acid copolymer.

Figure 13:
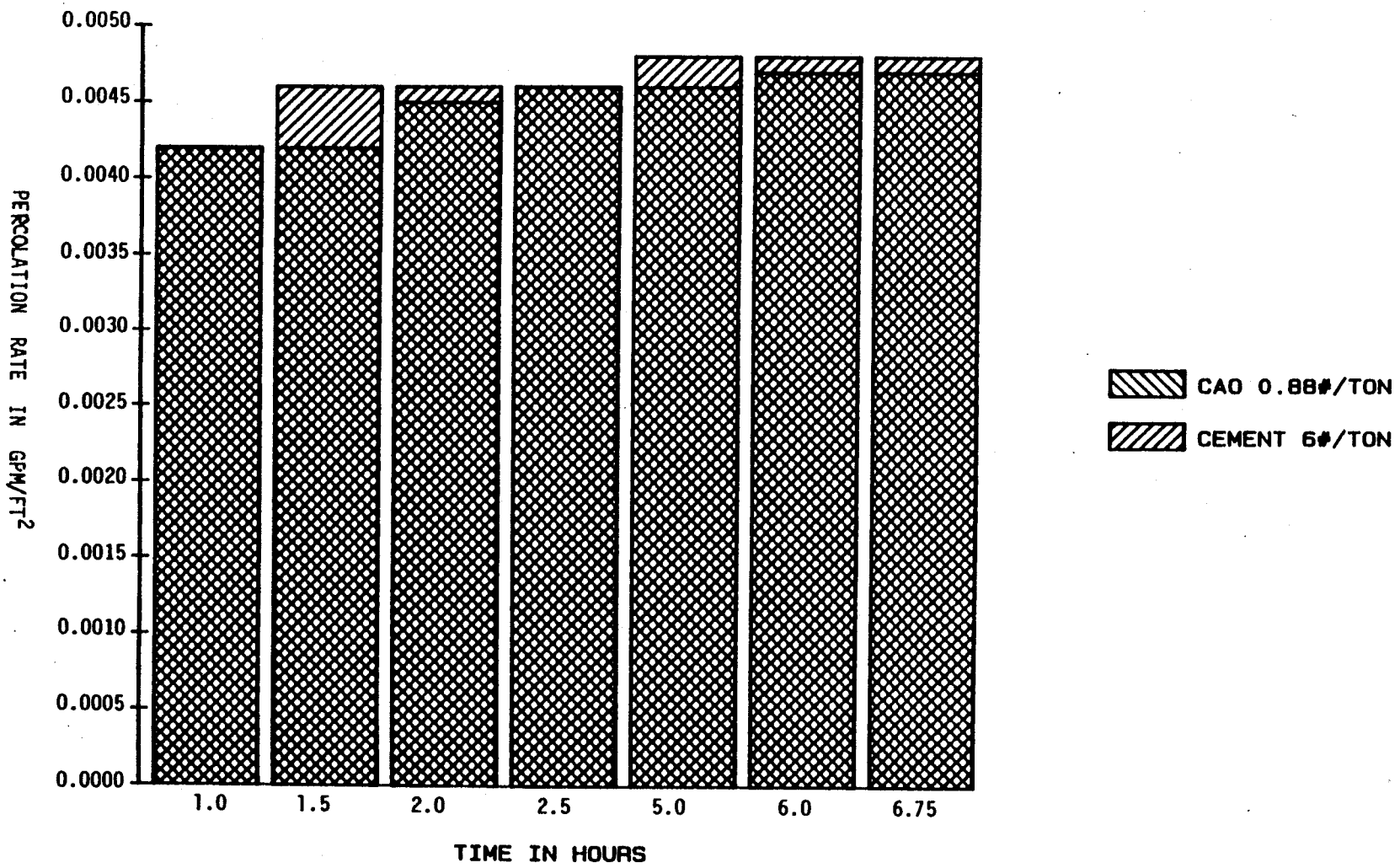

FIGS. 8 through 12 summarize percolation rate data using method two, for ore sample "D" agglomerated with cement at 6 pounds per ton and moderate molecular weight ($2\text{–}4\times10^6$) 70/30 AM/AA at the varying treatment levels. All treatments of the acrylamide/acrylic acid copolymer include 0.88 pounds per ton lime. As can be seen from FIG. 8, at a copolymer treatment level of only 0.5 pounds per ton, the initial percolation rates are lower than for a treatment for 6 pounds per ton of cement. As the treatment level of copolymer is decreased to 0.05 pounds per ton, FIGS. 9 through 12, the percolation rate for the copolymer/lime treated ore approaches that of the 6 pound per ton cement treated ore sample "D". FIG. 13 summarizes data for the measurement of percolation rate for ore sample "D" treated with 0.88 pounds per ton lime, and 6 pounds per ton cement. As shown by FIG. 13, the percolation rates are similar.

Figure 14:
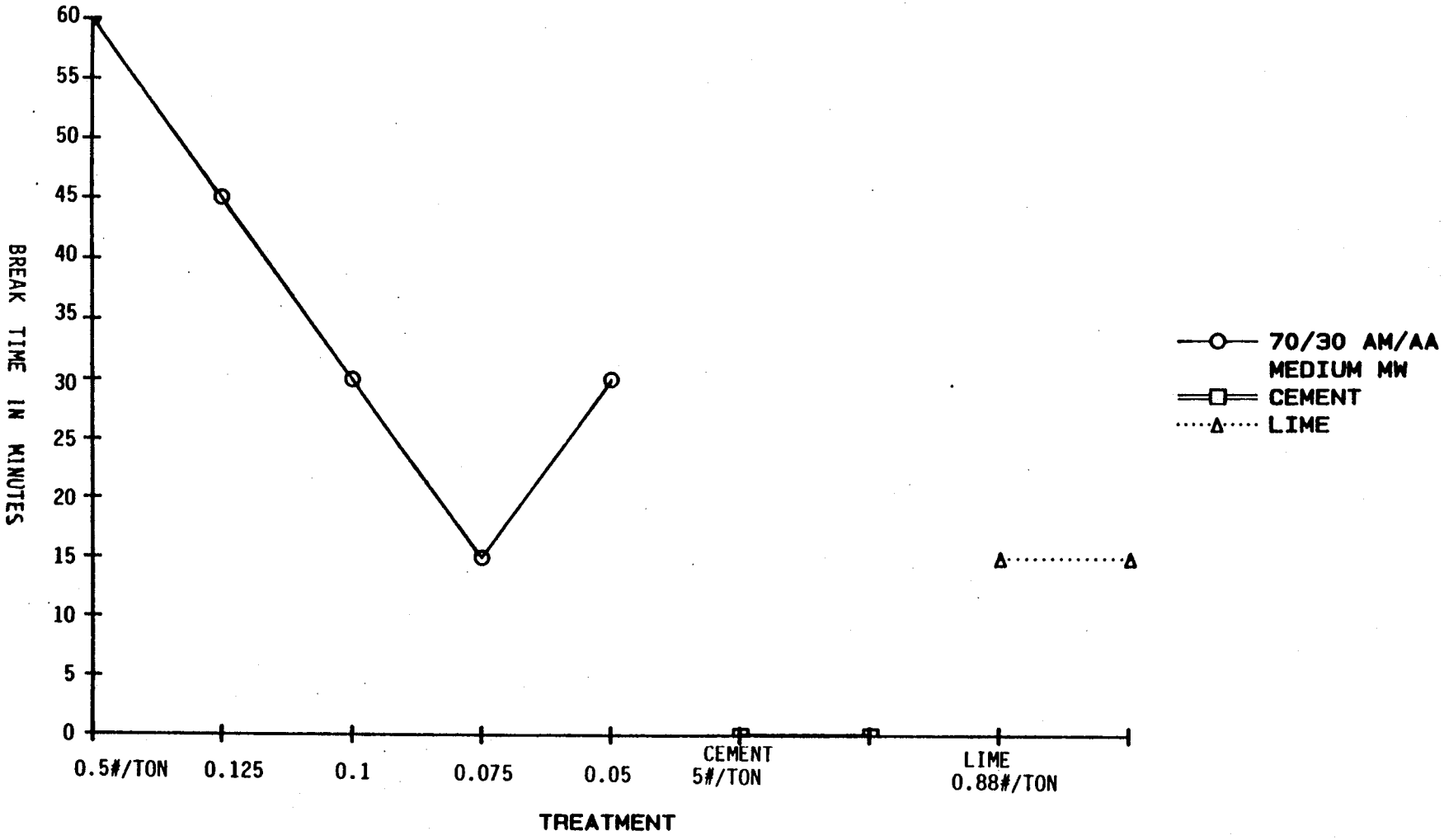
FIG. 14 is a graph showing break time in minutes for various treatments as described below.

FIG. 14 summarizes data of measuring the breakthrough time, that is the length of time between the feed of percolation solution to a column of treated ore and the time percolation solution effluent was detected leaving the base of the column. With 70/30 acrylamide/acrylic acid moderate molecular weight copolymer breakthrough times appeared to be a function of treatment rate. The breakthrough time for a copolymer treated with a 0.05 pounds per ton is anomalous. For cement, the breakthrough time was essentially 0, that is leaching effluent was detected essentially as soon as the percolating solution entered the top of the column.

The fines content in the leachate was determined for each run shown in FIG. 14 after the columns had been percolating for approximately 7 hours. Ores treated with the 70/30 acrylamide/acrylic acid moderate molecular weight copolymer at treatment rates of between 0.5 and 0.1 pounds per ton contained less than 0.1 grams of fines. As the copolymer treatment rate decreased the fines content increased. At a copolymer treatment rate of about 0.05 pound per ton the fines level was similar to cement treated at 6 pounds per ton. Lime was the least effective in retaining fines i.e., fines of approximately 0.4 grams were found when the treatment consisted solely of lime at 0.88 pounds per ton.

The anionic medium molecular weight (i.e., about 2 million) and high molecular weight (i.e., 12–16 million) 70/30 and 90/10 mole percent acrylamide/acrylic acid copolymers reported above are only illustrative of the type of polymer systems necessary for optimum effectiveness. In practice it is believed that 90/10 to 60/40 mole ratio acrylamide/acrylic acid copolymers with molecular weights between 1 and 16 million would be effective. Of course, derivatives of these copolymers could also be effective.

The preferred agglomerating agent of the present invention is a copolymer of acrylamide and acrylic acid in combination with lime. The mole ratio of acrylamide to acrylic acid can vary from about 90 to 10 to about 60 to 40. The preferred copolymer has a moderate to high molecular weight, that is from about one million up to above 8 million. The copolymer is preferably anionic, although it is believed that the presence of some cationic segments in the copolymer would not adversely affect the agglomeration action.

The most preferred agglomerating agent of the present invention is an anionic copolymer of acrylamide and acrylic acid with a monomer ratio of about 70 to 30 mole percent and having a molecular weight of above 8 million in combination with lime.

Typical treatment rates for the anionic/moderate to high molecular weight copolymer of the present invention range from about 0.1 up to about 2.0 pounds per ton of ore. The copolymer is preferably employed with sufficient lime to control pH to a pH of about 10.5. Typically about 0.88 pounds of lime per ton of treated ore is employed, but this will depend on the ore type being treated.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. In a process for percolation leaching of precious metal from a mineral bearing ore wherein the ore is first agglomerated with an agglomeration agent, formed into a heap and then leached by percolating a leaching solution through the heap which extracts the precious metal from the agglomerated ore for subsequent recovery, the improvement in which the agglomerating agent consists essentially of an anionic copolymer of acrylamide and acrylic acid wherein the mole ratio of acrylamide to acrylic acid ranges from about 90 to 10 to about 70 to 30, said copolymer having a molecular weight above about 1 million.

2. The process of claim 1, wherein said agglomerating agent further includes sufficient lime to provide a pH of from about 9.5 to 11.

3. The process of claim 2, wherein from about 1 to about 10 pounds of said lime, per ton of mineral bearing ore, is added.

4. The process of claim 1, wherein the molecular weight of said polymer is from about 1 million to about 16 million.

5. The process of claim 1, wherein the mole ratio of acrylamide to acrylic acid is about 70 to 30.

6. The process of claim 1, wherein said agglomerating agent is applied as a foam.

7. A method of extracting gold from gold ore by heap leaching with caustic cyanide comprising agglomerating the gold ore prior to being formed into a heap with an agglomerating agent consisting essentially of an anionic copolymer of an acrylamide and an acrylic acid in a ratio of acrylamide to acrylic acid ranging from about 90 to 10 to about 70 to 30, said copolymer having a molecular weight above about 1 million, at a treatment rate sufficient to provide an agglomerate having a percolation rate, higher than that obtained when cement is used as the agglomerating agent at the same treatment level and then leaching with caustic cyanide, collecting the gold rich leachate, and recovering gold thereform.

8. The method of claim 7 wherein said copolymer has a molecular weight of from about 1 million to about 16 million.

9. The method of claim 7 wherein the ratio of acrylamide to acrylic acid is about 70 to 30.

10. The method of claim 7 wherein said agglomerating agent is applied as a foam.

11. The method of claim 7, wherein said agglomerating agent further includes sufficient lime to provide a pH of from about 9.5 to 11.

12. The method of claim 11, wherein from about 1 to about 10 pounds of said lime, per ton of mineral bearing ore, is added.

13. A method of extracting gold from gold ore by heap leaching with caustic cyanide comprising agglomerating the gold ore prior to being formed into a heap with an agglomerating agent comprising anionic copolymer of an acrylamide and an acrylic acid in a ratio of acrylamide to acrylic acid ranging from about 90 to 10 to about 70 to 30, in the absence of cement, said copolymer having a molecular weight above about 1 million, at a treatment rate sufficient to provide an agglomerate having a percolation rate, higher than that obtained when cement is used as the agglomerating agent at the same treatment level and then leaching with caustic cyanide, collecting the gold rich leachate, and recovering gold thereform.

14. The method of claim 13 wherein said copolymer has a molecular weight of from about 1 million to about 16 million.

15. The method of claim 13 wherein the ratio of acrylamide to acrylic acid is about 70 to 30.

16. The method of claim 13 wherein said agglomerating agent is applied as a foam.

17. The method of claim 13, wherein said agglomerating agent further includes sufficient lime to provide a pH of from about 9.5 to 11.

18. The method of claim 17, wherein from about 1 to about 10 pounds of said lime, per ton of mineral bearing ore, is added.

* * * * *